United States Patent [19]

Kahre

[11] Patent Number: 5,042,656

[45] Date of Patent: Aug. 27, 1991

[54] METHOD OF PROTECTING DOORS AND DISPOSABLE ENVELOPE THEREFOR

[76] Inventor: Robert Kahre, 6080 S. Burham, Ste., 12, Las Vegas, Nev. 89119

[21] Appl. No.: 496,318

[22] Filed: Mar. 16, 1990

[51] Int. Cl.[5] ..... B65D 85/46

[52] U.S. Cl. ..... 206/321.0; 150/154

[58] Field of Search ..... 150/154, 155, 165; 206/321

[56] References Cited

U.S. PATENT DOCUMENTS

| | | | |
|---|---|---|---|
| 2,607,524 | 8/1952 | Gerson | 206/321 X |
| 2,757.854 | 8/1956 | Wall | 206/321 X |
| 4,921,028 | 5/1990 | Schwartz | 150/155 |

FOREIGN PATENT DOCUMENTS

| | | |
|---|---|---|
| 1419805 | 10/1905 | France . |
| 528332 | 9/1979 | Japan . |
| 862898 | of 1901 | United Kingdom . |

*Primary Examiner*—Michael Lusignan

*Attorney, Agent, or Firm*—Charles H. Thomas

[57] ABSTRACT

Disposable envelopes are providing for protecting interior doors during painting, construction or decorating. A plurality of disposable envelope are formed as rectangular structures which serve as sheaths to protect doors of a building during painting, spackling or other construction, repair of decorating projects. The envelopes are formed as large plastic paper sheaths and are pulled onto the edge of a door opposite the door edge hinged to the frame. The envelopes protect the door from paint, spackle and other material used in construction or decorating. Once painting or decorating is complete, the envelopes are removed from the doorsd and discarded.

8 Claims, 1 Drawing Sheet

METHOD OF PROTECTING DOORS AND DISPOSABLE ENVELOPE THEREFOR

BACKGROUND OF THE INVENTION

1. Field of the Invention

The present invention relates to a method and article for use in protecting doors within buildings during painting, construction or decorating.

2. Description of the Prior Art

During painting or redecorating of rooms within buildings the walls and ceilings within the vicinity of interior doors are frequently painted, although the doors themselves are often not painted at all or are not painted with the same paint. Nevertheless, as paint is brushed, rolled or sprayed onto the adjacent wall and ceiling surfaces, the doors are subject to being stained with unwanted droplets or drips of paint.

According to present techniques of painting and redecorating, doors are covered with drop cloths in order to protect them from inadvertent paint droplets and splatters. However, the use of conventional drop cloths is unsatisfactory in the protection of doors during painting and redecorating for several reasons.

Conventional drop cloths are large, expansive sections of thin plastic or canvas. When conventional drop cloths are draped over doors to protect the door surfaces from paint and other construction or decorating materials, they are deployed in a tent-like configuration draped over the top edge of the door. The door is therefore essentially immobilized on its hinges, and cannot be easily opened or closed further from the position it is in when the drop cloths are draped on it without significantly disrupting the drop cloth protection.

Furthermore, conventional drop cloths are of a size and configuration far too large and loose for satisfactory use in covering doors. A drop cloth draped over a door will typically hang with edges trailing on the floor on both sides of the door. The drop cloth hangs with drape-like folds at the edge of the door. Painters and other workmen moving in the area are very likely to step upon the trailing edges of conventional drop cloths and thereby pull the drop cloths totally or partially off of the doors they are intended to cover. This problem is aggravated by the bulkiness of the trailing material of conventional drop cloths. This trailing material represents an obstacle to ease of passage by painters and workmen through doorways. The loose and rumpled portions of drop cloths lying on the floor in a doorway make passage through the doorway by painters and workmen more difficult. This bulk of excess drop cloth material on the floor contributes to the likelihood that a drop cloth will be pulled out of position in which it is draped on a door during an attempted passage through a doorway.

A further difficulty with the use of conventional drop cloths to protect doors within a building is that passage by the building occupants through a doorway is further obstructed by the bulky, draping folds that typically hang from the edge of the door opposite the hinged door edge from which the door is mounted to the door frame. The use of conventional drop cloths for covering doors within buildings during painting and decorating thereby presents an impediment to movement through the building and increases the time required to complete the painting or redecorating tasks to be performed. Furthermore, when a drop cloth is inadvertently pulled off of a door by trodding on the loose material near the bottom of the door, the falling drop cloth can brush against freshly painted surfaces, thereby disturbing the appearance of fresh paint on those surfaces.

SUMMARY OF THE INVENTION

In one broad aspect the present invention may be considered to be a disposable article of manufacture for protecting a door. Such a door is mounted in a door frame along one edge on a building. The article of manufacture for protecting the door is comprised of an envelope formed as a rectangular structure and having a pair of layers of flexible material arranged in mutually superimposed disposition. The flexible layers may either be formed of paper or a lightweight plastic, such as polyethylene. Whatever the material, the flexible layers are closed together throughout three sides of the rectangular structure of the envelope, but are unsecured along the fourth side. The flexible layers thereby form an enclosure with an open mouth large enough to span the door from top to bottom. The envelope is thereby able to serve as a protective sheath about the door with the mounted, hinged edge of the door residing in the mouth of the enclosure.

One important object of the present invention is to provide a convenient means for protecting doors within buildings from paint droplets and drips during painting and redecorating. This objective is achieved without obstructing doorways with unnecessarily bulky sections of drop cloths.

A further object of the invention is to provide a means for protecting doors within buildings during painting, construction and decorating which presents minimal obstruction to painters and workmen in the area. By protecting the doors with sheaths which are configured to conform to the size and shapes of doors in buildings, excessive volumes of drop cloth material in doorways are avoided. Also, by protecting doors within buildings with closely fitting sheaths the painters and workmen are able to move about more freely and easily through doorways and in the vicinity of doors in the building. Therefore, the tasks of painting and redecorating can be performed more quickly than has heretofore been possible.

In another broad aspect the present invention may be considered to be a method of protecting a door that is mounted along one edge within a door frame on a building. According to the method a rectangular envelope is formed having pairs of mutually perpendicular sides from a pair of rectangular layers of flexible material arranged in mutually superimposed disposition closed together throughout along three of the sides of the rectangular envelope. The layers are left unsecured along the remaining side. The envelope thereby forms an enclosure with an open mouth large enough to span the door from top to bottom. According to the method, one encompasses the door within the envelope so that the envelope serves as a protective sheath about the door with the mounted edge of the door residing in the mouth of the envelope. The envelope is subsequently removed from the door and discarded.

In still another aspect the invention may be considered to be an improvement to a method of painting the interior of a building. According to the improved painting method the doors within the building, which are each mounted along one edge within a door frame, are protected using a plurality of rectangular sheaths. Each of the rectangular sheaths is formed of a pair of layers of flexible material which are closed together throughout along three sides and which define a mouth opening between the layers at the remaining side. Protection is accomplished by encompassing each of the doors within a separate one of the sheaths. Each door is thereby enclosed within a sheath. Painting tasks to be performed are then conducted in the vicinity of the doors. Subsequently, the sheaths are removed from the doors and discarded.

Preferably the envelope of the invention is formed using a single sheet of plastic material. In one form of construction the single sheet of material is folded in half so that one of the closed sides is formed by the fold. Two other sides of the sheet are then secured together throughout their lengths, such as by thermally fusing the peripheral edges of the layers together in a seam, or by some other means. In any event, one side of the rectangular structure is left open to serve as the mouth of the sheath.

In one alternative construction a single sheet of materials is initially formed as a large, tubular structure that is ten flattened to form a pair of layers which are closed together throughout along two opposite parallel edges by the folds in the structure delineating the layers. The tubular structure is then cut transversely into sections, thereby producing a plurality of rectangular sections. One of the sides of each section extending transversely between the folds is sealed throughout along its length, preferably by thermal fusion. The opposite transverse side of each section is left open. The different sections thereby form a plurality of envelopes according to the invention with the open side of each section forming the mouth of the enclosure thereof.

In still another manner of construction the envelope is formed by a pair of separate, congruent, rectangular sheets of material which are disposed one atop another. The sheets of material are sealed throughout along three sides, while the fourth side is left open to form the mouth of the enclosure.

The envelope of the invention may be formed of a pair of layers of a lightweight plastic, such as polyethylene, wherein each layer is approximately one mil in thickness. The thin plastic has sufficient tensile strength so that it will not easily tear, but is quire light in weight. Paint will not penetrate the plastic so that a door encased within the plastic sheath will be protected from dripping paint and from droplets emanating from a paint sprayer.

It may be desirable to construct the flexible envelope of the invention from paper. The paper can be of sufficient thickness and texture so that paint will not penetrate through to the door enclosed therewithin. A paper envelope has the advantage of being constructed of a material which will undergo rapid, biodegradable composition at the end of its useful life.

Preferably, a plurality of disposable envelopes of the type described are compactly packaged together so as to occupy a minimum of volume prior to use. The envelopes can be folded and packed in a polyethylene bag from which one envelope at a time can be easily withdrawn. It may be advantageous for the envelopes to be packed in a carton or box, with the juxtaposed peripheral margins of adjacent envelopes arranged in an interleaved fashion. If the trailing edge of one envelope is tucked beneath the leading edge of the next sequential envelope in such a packaging arrangement, the trailing edge of an envelope initially withdrawn from the box will pull the leading edge of the next sequential envelope out of the box as it is withdrawn. This leading edge of the next sequential envelope can then be easily grasped for subsequent withdrawal, and the trailing edge of that envelope will pull the leading edge of the next following envelope out of the box.

The practice of the method of the invention readily lends itself to painting and repainting of interior building walls. However, both the method and the article used in the practice of the method are advantageously employed in construction and decorating projects other than merely painting. For example, the doors within a building can be protected in the manner and using the envelopes described during plastering, spackling, wall papering and other comparable construction and decorating tasks.

The invention may be described with greater clarity and particularity with reference to the accompanying drawings.

DESCRIPTION OF THE EMBODIMENT AND IMPLEMENTATION OF THE METHOD

Figure 3:
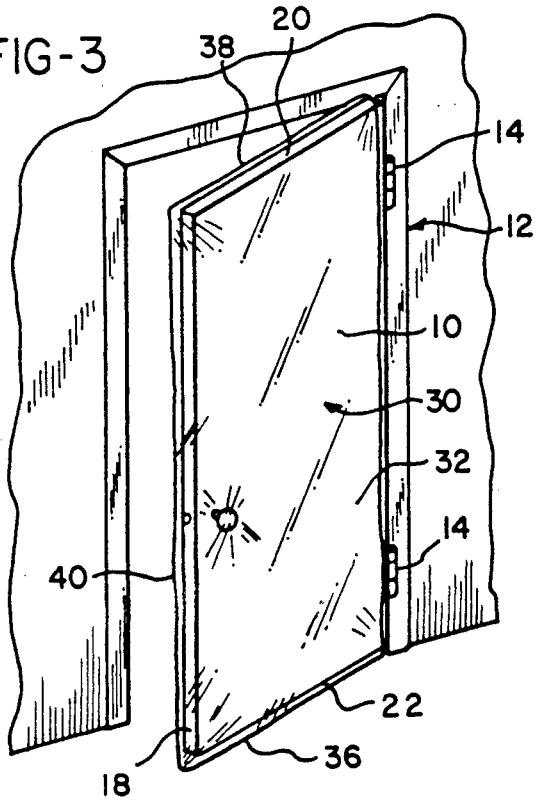
FIG. 3 is a perspective view illustrating a door protected by a disposable envelope according to the invention.

FIG. 3 illustrates the use of a disposable article according to the invention for protecting a door 10 which is mounted in a door frame 12. The door 10 is mounted in the door frame 12 along a door edge 16 having hinges 14. The hinges 14 are connected to the door frame 12 within a building in a conventional manner.

Figure 1:
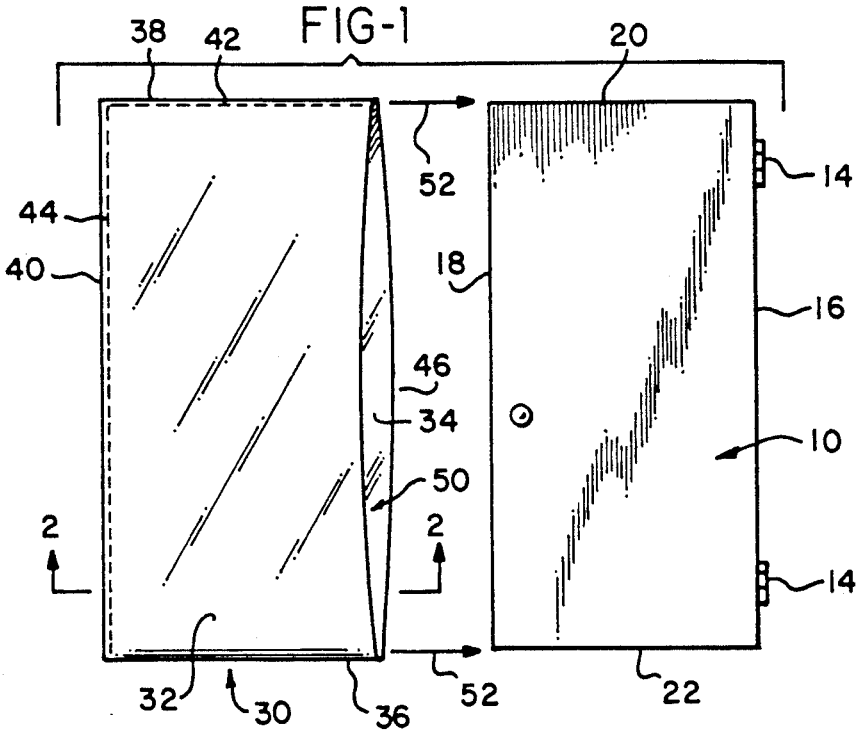
FIG. 1 is a diagrammatic elevational view illustrating both the method and the article of the invention.
Figure 2:
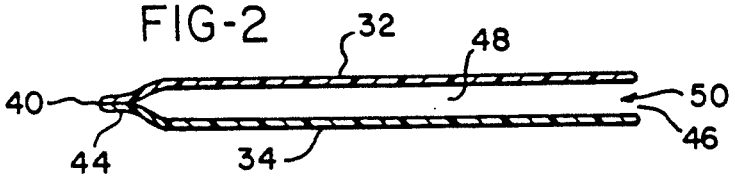
FIG. 2 is a sectional detail taken along the lines 2—2 of FIG. 1.

Most interior doors currently in use within buildings are of standardized sizes. Interior doors typically are of a width of thirty, thirty-two or thirty six inches and are eighty inches in length. The pair of long edges 16 and 18 of the door 12 depicted in FIGS. 1 and 3 are eighty inches long. The door edge 16 is the edge which is hinged to the frame 12 while the door edge 18 is the door edge that is opposite therefrom and parallel thereto. The other pair of door edges 20 and 22 are mutually parallel to each other and are perpendicular to the edges 16 and 18. The top door edge 20 and the bottom door edge 22 may, for example, be thirty-two inches in length. Together the door edges 16, 18, 20 and 22 define the rectangular structure of the door 10. According to the invention a disposable envelope 30 is used to encapsulate the door 10.

In the practice of the invention the door guard or envelope 30 is slipped like a sleeve or jacket edgewise onto the door 10 prior to painting. Once the painting operations have been concluded, the door guard is removed and discarded. The disposable door guards can be packaged together in a box, so that by pulling one door guard or envelope 30 out of the box, the leading side of the next envelope 30 is exposed.

According to the invention the envelope 30 is formed as a rectangular structure and has a pair of layers 32 and 34 formed of flexible material, such as polyethylene plastic one mil in thickness. The layers 32 and 34 are formed of a single sheet of polyethylene material which is fourteen feet in width. This sheet of material is folded in half along a folded side 36. The side 38 parallel to and opposite the side 36, and the side 40 of the rectangular structure formed by the superimposed layers 32 and 34 are sealed by seams, indicated respectively at 42 and 44. These seams are preferably formed by fusing the juxtaposed edges of the layers 32 and 34 together along the sides 38 and 40 of the folded sheet of material. The sides 36, 38 and 40 are thereby each closed together throughout to form the three closed sides of the envelope 30. The exposed edges of the layers 32 and 34 are left unsecured along the fourth side 46 of the envelope 30 to thereby form an enclosure 48 having an open mouth 50 that is large enough to span the door 10 from the top edge 20 to the bottom edge 22.

The envelope 30 is suitable for use to serve as a protective sheath about the door 10. Specifically one encompasses the door 10 within the envelope 30 by sliding the envelope 30 onto the door 10 from the edge 18 within the frame 12 in the direction indicated by the directional arrows 52 in FIG. 1. The door edge 18 enters the mouth 50 of the envelope 30, and the envelope 30 is pulled to the right, as illustrated in FIG. 1 until the hinged edge 16 of the door 10 resides in the mouth 50 of the enclosure 48. The envelope 30 thereby encloses and encompasses the door 10 in the manner illustrated in FIG. 3.

The envelope 30 thereupon serves as a protective sheath about the door 10 with the mounted edge 16 of the door 10 residing in the mouth 50 of the envelope 30. The sides 36 and 38 of the envelope 30 are preferably forty inches in length, so that the envelope 30 can be used with even the largest sizes of doors which are normally used within buildings.

Preferably, the envelope 30 is pulled snugly about the door 10 until the edge 18 of the door 10 resides in abutment against the interior of the seam 44 at the edge 40 of the envelope 30. This minimizes any obstruction that would otherwise be presented by excess material of the envelope 30 in the door opening. The corners of the layers 32 and 34 of the envelope 30 at the ends of the mouth 50 may be folded over above the upper hinge 14 and below the lower hinge 14. These corners may be folded back in flaps and held in position against the remaining portion of the envelope 30 by means of masking tape or some other temporary fastener so as to firmly, but temporarily secure the envelope 30 snugly about the door 10.

Following the termination of painting or other construction or decorating tasks, the envelope 30 is pulled away from the door 10 in the direction opposite the direction of the arrows 52 of FIG. 1. Once the envelope 30 is pulled free from the door 10 and totally removed therefrom it is discarded.

The system for protecting doors during painting and other construction and redecorating projects provides an efficient and useful means for protecting doors from paint splatters and other materials using disposable sheaths or jackets. A separate envelope 30 is employed for each door to be protected. Following use, all of the paint splattered, used envelopes 30 may be bundled together and discarded.

Undoubtedly, numerous variations and modifications of the invention will become readily apparent to those familiar with painting, decorating, and construction supplies and techniques. For example, the system can be used to protect exterior doors as well as interior doors. Accordingly, the scope of the invention should not be construed as limited to the specific embodiment depicted and described herein, but rather is defined in the claims appended hereto.

I claim:

1. A disposable article of a size suitable for protecting a door mounted in a door frame along one edge on a building comprising an envelope formed as a rectangular structure and having a pair of layers of flexible material both at least as large as said door, each having a pair of short sides, and a pair of long sides and arranged in mutually superimposed disposition and closed together throughout along both of said short sides and along one of said long sides and unsecured along the other long side thereby forming an enclosure with an open mouth large enough to span said door from top to bottom, whereby said envelope serves as a protective sheath about said door with the mounted edge of said door residing in the mouth of said enclosure.

2. An article according to claim 1 wherein said layers of flexible material are formed of plastic.

3. An article according to claim 2 wherein said layers of flexible material are each about one mil in thickness.

4. An article according to claim 1 wherein said layers of flexible material are each paper.

5. A method of protecting a door mounted along one hinged edge within a door frame on a building and having an opposite free edge comprising: forming a rectangular envelope of a size large enough to envelope said door and having pairs of mutually perpendicular sides from a pair of rectangular layers of flexible material both at least as large as said door and arranged in mutually superimposed disposition, each layer having a pair of short sides and a pair of long sides, and wherein and said layers are closed together throughout along both of said short sides and along one of said long sides and are unsecured along the remaining long side, thereby forming an enclosure with an open mouth large enough to span said door from top to bottom, encompassing said door within said envelope by pulling said mouth of said envelope over said free edge of said door and advancing said mouth of said envelope from side free edge of said door to said hinged edge of said door so that said envelope serves as a protective sheath about said door with the mounted edge of said door residing in the mouth of said envelope, and subsequently removing said envelope from said door and discarding said envelope.

6. A method according to claim 5 further comprising forming said envelope from a single sheet of plastic material.

7. A method according to claim 5 further comprising forming said envelope from a single sheet of paper.

8. In a method of painting the interior of a building, the improvement comprising protecting doors within said building, each mounted along one hinged edge within a door frame and having an opposite free edge, using a plurality of rectangular sheaths, each of which is large enough to envelope a door within said building and each of which is formed of a pair of layers of flexible material each at least as large as said door, said layers in a pair each having a pair of short sides and a pair of long sides, and being closed throughout along both of said short sides and along one of said long sides and defining a mouth opening between said layers at the remaining long side comprising: encompassing each of said doors within a separate one of said sheaths by pulling said mouth of said envelope over said free edge of said door, and advancing said mouth of said envelope from side free edge of said door to said hinged edge of said door, painting in the vicinity of said doors, and subsequently removing and discarding said sheaths from said doors.

* * * * *